United States Patent [19]

Nakajima et al.

[11] 4,045,165

[45] Aug. 30, 1977

[54] CONTACT HEAT FIXING DEVICE

[75] Inventors: Takanobu Nakajima, Kashihara; Toshikazu Matsui, Kishiwada; Tatsuo Aizawa, Osaka, all of Japan

[73] Assignee: Mita Industrial Co., Ltd., Japan

[21] Appl. No.: 623,327

[22] Filed: Oct. 17, 1975

[30] Foreign Application Priority Data

Oct. 19, 1974 Japan ..... 49-120466

[51] Int. Cl.[2] ..... F27B 9/28

[52] U.S. Cl. ..... 432/60; 118/60

[58] Field of Search ..... 118/60, 70, 104, 203, 118/637, 243, 260; 432/59, 60, 228

[56] References Cited

U.S. PATENT DOCUMENTS

| | | | |
|---|---|---|---|
| 3,449,548 | 6/1969 | Adamek et al. | 118/60 X |
| 3,722,993 | 4/1972 | Egnaczak | 118/637 X |
| 3,908,594 | 9/1975 | Matsumoto et al. | 118/70 X |

*Primary Examiner*—Dorsey Newton

*Attorney, Agent, or Firm*—Wenderoth, Lind & Ponack

[57] ABSTRACT

A contact heat fixing device which comprises a driving heated roller having a heating mechanism disposed in the interior thereof and a surface coated with an offset preventing material, a press roller which is rotated in intimate contact under pressure with said heat roller, a vessel for containing therein an offset preventing liquid and a feed mechanism for supplying the offset preventing liquid to the heated roller from the vessel, fixation of a toner image being accomplished by the passage of a support having the toner image thereon through the nip position of the heated roller and the press roller, wherein said feed mechanism includes an applicator for applying the offset preventing liquid to the surface of the heated roller and supply means for supplying the offset preventing liquid from the vessel to the applicator, said applicator being arranged so that it can shift between a position (PI) where it has a pressing contact with said supply means and a position (P2) where it has a pressing contact with said heated roller, in such a manner that the offset preventing liquid is supplied to said applicator when it is at said position (P1), the applicator is moved from said position (P1) to the position (P2) synchronously with feeding of said support to have temporary contact with the surface of the heated roller and apply thereto the offset preventing liquid, and the applicator is then returned to the position (P2).

4 Claims, 2 Drawing Figures

CONTACT HEAT FIXING DEVICE

Figure 1:
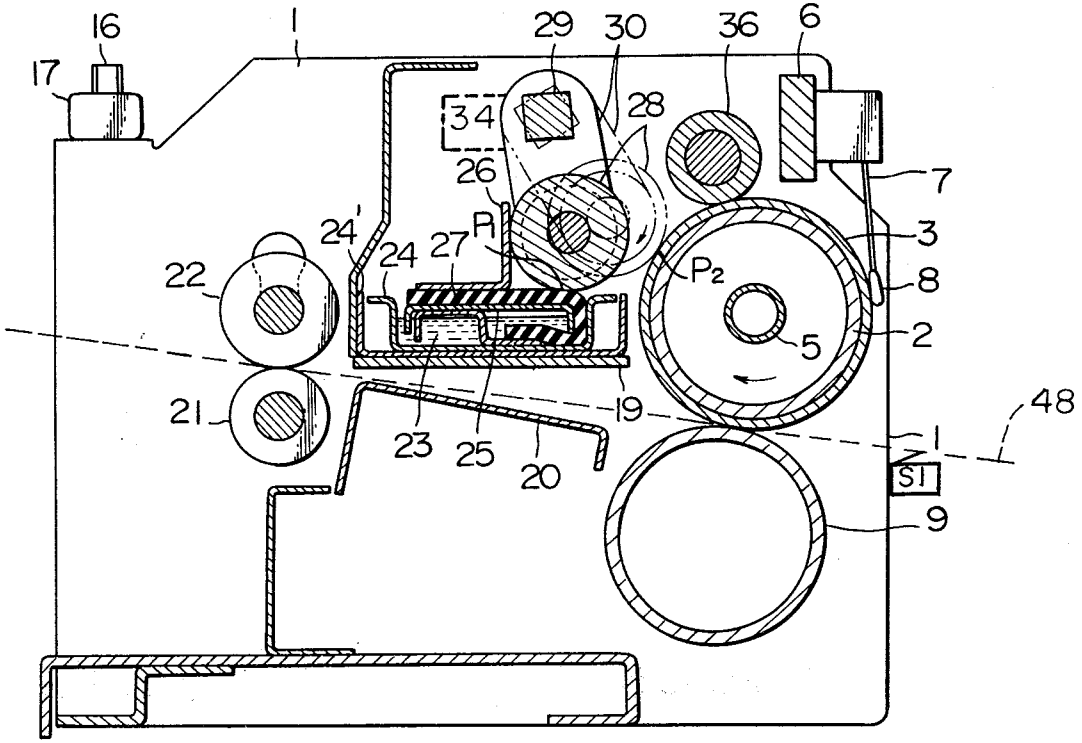

This invention relates to a contact heat fixing device in which a toner image electrostatically carried on a copying paper is passed through between a heated roller and a press roller having an intimate contact under pressure with said heated roller to fuse the toner image on the copying paper. More particularly, the invention relates to a contact heat fixing device of the above-mentioned type in which an offset-preventing liquid such as a silicone oil is coated on the surface of the heated roller.

It is a primary object of the present invention to provide a contact heat fixing device of a very simple structure in which an offset-preventing liquid is supplied to the surface of a heated roller in a minimum amount necessary for preventing offset of toner onto the surface thereof at every copying operation to form a uniform liquid film of the offset-preventing liquid at the position where the heated roller has an intimate contact under pressure with a press roller and off-set is effectively prevented by the presence of said liquid film, and in which fusing of a toner image on a copying paper can be accomplished effectively without staining or contamination of the copying paper.

Another object of the present invention is to provide a contact heat fixing device in which a feed member for supplying an offset-preventing liquid to the surface of a heated roller can be effectively prevented from deformation, abrasion or degradation and the durability of said feed member can be markedly improved.

In conventional contact heat fixing devices, supply of an offset-preventing liquid is performed by an offset preventing liquid feed member which is always pressed and contacted with the surface of which is always pressed and contacted with the surface of a heated roller. Accordingly, the offset-preventing liquid is consumed very wastefully, and further, since the feed member readily undergoes deformation, abrasion or degradation under the heat of the heated roller and/or the offset-preventing liquid, exchange of the feed member with fresh one should be conducted very frequently.

As means for overcoming the foregoing disadvantages, there has been proposed a device in which the feed member is contacted with the surface of the heated roller only when a copying paper is passing through between the heated roller and the press roller. According to this proposal, however, it is difficult to feed the offset-preventing liquid in a minimum amount necessary for preventing offset of toner onto the surface of the heated roller, and an excessive amount of the offset-preventing liquid is supplied at one time and the copying paper is stained and contaminated with the liquid.

The known offset-preventing liquid feed mechanisms are defective in that the toner which is more or less offset onto the heated roller is transferred and accumulated on the offset preventing liquid feed device during use and its capacity is gradually lowered by a layer of the so deposited toner on the surface of the heated roller, which is composed of an offset preventing material such as polytetrafluoroethylene, is scared and damaged.

In accordance with the present invention, there is provided a contact heat fixing device which comprises a driving heated roller having a heating mechanism disposed in the interior thereof and a surface coated with an offset preventing material, a press roller which is rotated in intimate, contact under pressure with said heated roller, a vessel for containing therein an offset preventing liquid and a feed mechanism for supplying the offset preventing liquid to the heated roller from the vessel, fixation of a toner image being accomplished by the passage of a support having the toner image thereon through the nip position of the heated roller and the press roller, wherein said feed mechanism includes an applicator for applying the offset preventing liquid to the surface of the heated roller and supply means for offset preventing liquid from the vessel to the applicator, said applicator being arranged so that it can shift between a position (P1) where it has a pressing contact with said supply means and a position (P2) where it has a pressing contact with said heated roller, in such a manner that the offset preventing liquid is supplied to said applicator when it is at said position P1, the applicator is moved from said position P1 to the position P2 synchronously with feeding of said support to have a temporary contact with the surface of the heated roller and apply thereto the offset preventing liquid, and the applicator is then returned to the position P2.

Figure 2:
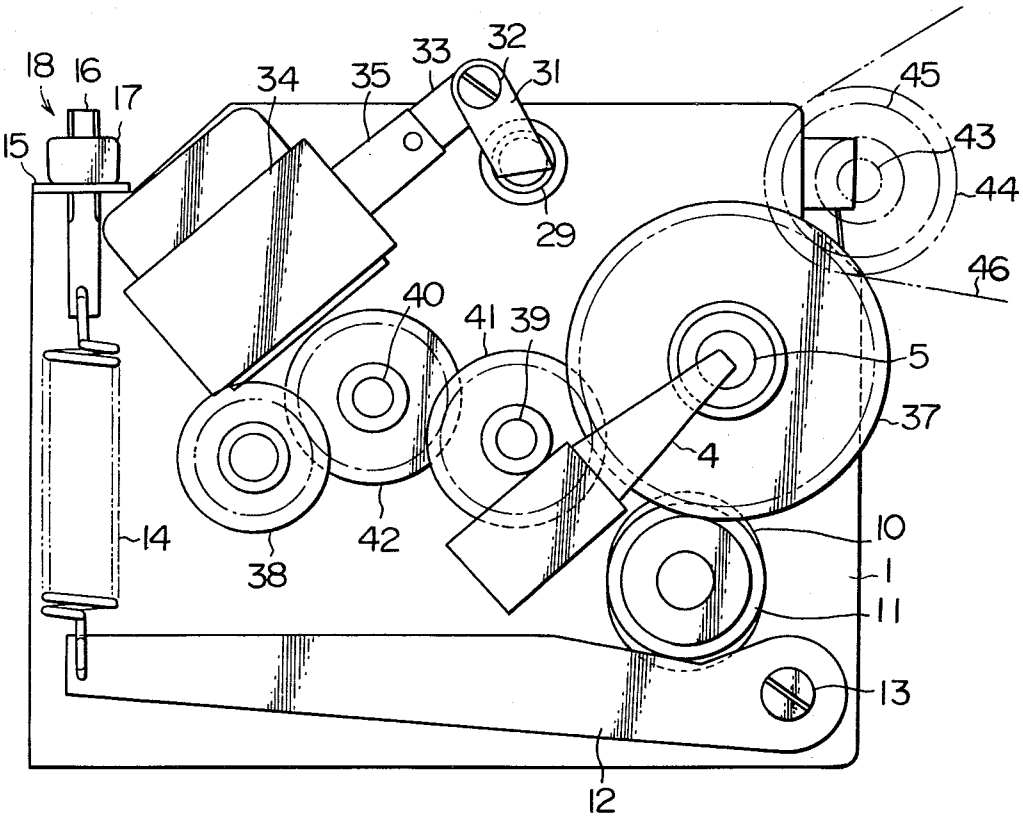

The present invention will now be illustrated in detail by reference to embodiments shown in the accompanying drawings, in which:

FIG. 1 is a view illustrating the side section of one embodiment of the contact heat fixing device of the present invention; and FIG. 2 is a side view of the device of FIG. 1.

Referring now to FIG. 1, a heated roller 2 is rotatably mounted on a frame plate 1 through a bearing (not shown) and the roller 2 is always rotated in a direction indicated by an arrow (in the clockwise direction) by a driving force transmitted from a drive mechanism (described hereinafter) disposed in the interior of a machine. The periphery of the heated roller 2 is covered with an offset preventing material 3 excellent in the peeling property, the heat resistance and the abrasion resistance and capable of being elastically deformed, such as a silicone rubber or polytetrafluoroethylene. In the interior of the heated roller 2, a heater 5 is supported on terminal 4 (see FIG. 2) fixed to the frame plate 1 independently from the heated roller 2 so that it has not any contact with the inner face of the heated roller 2.

With the peripheral face of the heated roller 2 is contacted a heat sensitive element 8, for example, Thermister (tradename for a product manufactured by Nippon Denki Kabushiki Kaisha), mounted on a supporting member 7, one end of which is fixed to a supporting lever 6 fixed to the frame plate 1. The Thermister 8 is electrically connected to a temperature control circuit (not shown) which is wired to the heater 5 to which electric current is applied through the terminal 4, so that the surface of the heated roller 2 can always be maintained at an optimum fixing temperature by lighting off and on the heater 5.

A press roller 9 composed of a material having a good heat conductivity such as a metal, a resin or a rubber, which is rotated by the heated roller 2, is disposed below the roller 2, and while a copying paper carrying an unfused toner image composed of a heated fusible resin composition passes through between the two rollers 2 and 9 with the toner image facing the heated roller, the toner image is fused on the paper support. As is illustrated in FIG. 2, the press roller 9 is rotatably mounted on a bearing 11 fitted vertically movably in a long hole 10 of the frame plate 1. The bearing 11 always receives an upward force so that the bearing 11 is always pressed in an upper concave portion of a pressing member 12 and the press roller 9 is always caused to have an intimate contact under pressure with the heated roller 2 by means of the pressing member 12. One end of the pressing member 12 is rotatably fitted to the frame plate 11 by means of a screw 13 and the other end of the pressing member 12 is connected through a spring 14 to an adjustment mechanism 18 including a screw 16 and a nut 17 mounted on a projection 15 of the frame plate 1, whereby the pressing member 12 is suitably contacted with the lower side of the bearing 11. More specifically, a force of rotation in the anticlockwise direction is always imposed on the pressing member 12 by means of the spring 14 to impart an upward force to the bearing 11, and the pressing force of the press roller 9 to the heated roller 2 can be adjusted by the adjustment of the nut 17.

A stay 19 fixed to the frame plate 11 is disposed on the side of the heated roller 2 and a passage for a copying paper is fromed between this stay and a lower guide plate 20. A copying paper which has passed through between the heated roller 2 and the press roller 9 and carries a fused toner image thereon travels through this passage and arrives at a pair of discharge rollers 21 and 22. Then, the copying paper is withdrawn from the machine by the action of the rollers 21 and 22.

On the stay 19, there are dismountably disposed a vessel 24 in which a prescribed amount of an offset preventing liquid 23, such as a silicone oil, is always filled according to a known method and an auxiliary saucer 24' for containing therein the offset preventing liquid overflown from the vessel 24.

One of important features of the device of the present invention resides in that a feed mechanism comprising an applicator 28 for applying the offset preventing liquid to the surface of the heater roller 2 and supply means 27 for supplying the offset preventing liquid to the applicator 28 from said vessel 24 is disposed to feed the offset preventing liquid to the heated roller 2 and this applicator 28 is arranged so that it can shift between a position P1 at which it has a pressing contact with the supply means 27 and a position P2 at which it has a pressing contact with the heated roller 2.

The offset preventing liquid is supplied to the applicator 28 at the position P1 at which it has a pressing contact with the supply means 27.

In a preferred embodiment of the present invention, this supply means 27 is composed of a porous material having a liquid absorbing property, and one end of this porous material is located above the liquid level in the vessel 24 at the position P1 having a pressing contact with the applicator 28 and the other end of the porous material is immersed in the liquid 23 filled in the vessel 24. A felt composed of wool, polytetrafluoroethylene fiber, aromatic polyamide fiber, glass fiber or a mixture thereof is preferably employed as such porous material. The offset preventing liquid 23 is naturally pumped up to the position P1 through the interior of the porous material 27 by the capillary phenomenon.

The supply means 27 is supported on the above-mentioned position by means of a supporting stand 25 in the vessel 24 and a stopper 27 detailed below A roller, at least the surface portion of which is composed of a porous material having a liquid absorbing property and being excellent in the heat resistance and the abrasion resistance, is preferably used as the applicator 28. As such porous material, there are preferably employed foams of a silicone rubber and an acrylonitrilebutadien copolymer rubber (NBR), for example, "Banpola" (tradeaname for a product manufactured by Bando Kagaku Kabushiki Kaisha). The applicator roller 28 is pivoted on a free end of a rotary arm 30, the other end of which is fixed to a shaft 29 rotatably fixed to the frame plate 1, through a one-way bearing (now shown) or the like so that the applicator roller 28 is rotated only in the same direction as the rotation direction of the heated roller 2, namely in the clockwise direction. In this arrangement, the roller 28 can swing between the positions P1 and P2 with the shaft 29 as the center.

As is shown in FIG. 2, to one end of said shaft 29 is connected one end of a connecting plate 31, and the other end of the connecting plate 31 is connected to a plunger 35 of an electromagnetic solenoid 34 through a connecting plate 33 connected rotatably thereto. In this arrangement, when electric current is applied to the solenoid 34, it attracts the plunger 35 and rotates the shaft 29 through the connecting plates 33 and 31, whereby the rotary arm 30 pivoted on the shaft 29 is rotated. At this point, the application roller 28 pivoted on the other end of the rotary arm 30 is let to fall in pressing contact with the stopper 28 by its own weight and it shifts from an ordinary position at which it has a pressing contact with the supply means 27 (the position P1 indicated by a solid line) to a position at which it has a pressing contact with the surface of the heated roller 2 (the position P2 indicated by a two-dot chain line). While the applicator roller 28 is maintained at this position P2, it applies the offset preventing liquid 23 to the surface of the heated roller 2. Since it moves on the supply means 27 while having a pressing contact therewith when it shifts from the position P1 on the horizontal portion of the supply means 27, the applicator roller 28 is rotated in the same direction (indicated by an arrow) as the rotation direction of the heated roller 2 by the friction between the applicator roller 8 and the supply means 27. Further, since the applicator roller 28 is rotated only in the same direction as the rotation direction of the heated roller 2, it is prevented from rotation even when it has a pressing contact with the heated roller 2. When application of electric current to the solenoid 34 is broken off, the applicator roller 28 returns to the original position P1 indicated by the solid line, and at this position it stands by in the stationary state for the next operation.

In the present invention, it is preferred that the degree of the friction between the applicator roller 28 and the horizontal extension of the supply means 27 be such that every time the applicator roller 28 makes one course of the swingling movement, the applicator roller 28 contacts the horizontal portion of the supply means 27 at a portion of the surface that is different from the portion where it had the contact with the supply means 27 before the swinging movement. It is especially preferred that the degree of said friction be such that when the applicator roller 28 shifts from the position P1, it is rotated by a length corresponding to the longitudinal contact length between the applicator roller 28 and the horizontal portion of the supply means 27.

In the fixing device of the present invention, since, as pointed out hereinbefore, the applicator roller 28 is rotated only in the same direction as the rotation direction of the heated roller 2, the offset preventing liquid impregnated in the press-contact portion of the applicator roller 28 is squeezed out and supplied to the heated roller 2 always in a uniform amount in a short time.

As pointed out hereinbefore, the applicator roller 28 is disposed so that when the applicator roller 28 shifts from the position P1 at which it has a pressing contact with the supply means 27, it is slightly rotated by said supply means 27. Accordingly, when the applicator roller 28 comes into pressing contact with the heated roller 2, the roller 28 is contacted with the surface of the heated roller 2 always at a different portion of the surface of the roller 28, and therefore, the durability of the applicator roller 28 can be highly improved without deformation, abrasion or degradation.

Furthermore, since the applicator 28 is contacted with the heated roller 2 at a different portion of the surface of the applicator 28 at every operation, there is not caused a disadvantage that a peculiar portion of the surface of the applicator roller 28 is stained or contaminated with the toner, and therefore, reduction of the offset preventing liquid feed capacity of the applicator or formation of scars on the offset preventing material of the heated roller 2 can be effectively prevented.

In the foregoing embodiment, the shaft 29 is connected to the plunger 35 of the electromagnetic solenoid 34 through a link mechanism. In the present invention, it is possible to adopt, instead of the above arrangement, an arrangement where the shaft 29 is connected to a rotor of an electromagnetic rotary solenoid to effect the rotation of the shaft 29, namely the swinging movement of the applicator 28.

In the present invention, the swinging movement of the applicator 28 from the position P1 to the position P2 is performed synchronously with feeding of a copying paper. In the device shown in the drawings, in order to energize the solenoid 34 in connection with a mechanism to be actuated at every copying operation synchronously with feeding of a copying paper, an arrangement is made so that the solenoid 34 is energized in synchronism with the operation of a cutter (not shown) disposed in the copying machine for cutting a roll-like copying paper 48 in a length corresponding to the length of an original to be copied. In other words, in response to energization and de-energization of a solenoid for the cutter mechanism, the solenoid 34 is energized via switch $S_1$, of FIG. 1 and de-energized. By this control, the time for the applicator 28 to have a pressing contact with the heated roller 2 is optimally shortened and the surface deformation or abrasion of the applicator 28 by the heat of the heated roller 2 can be effectively prevented to enhance the durability or life of the applicator 28. An appropriate time for the applicator 28 to have a pressing contact with the heated roller 2 varies depending on the material of the applicator 28 and the like factors, but in general, it is preferred that the operation of the solenoid be controlled so that the above contact time is a minimum time necessary for feeding the offset preventing liquid 23 to the heated roller 2 in an amount required for fixation of one sheet of copying paper. This time is generally within a range of from 0.1 to 1 second.

In the present invention, it is preferred that a levelling roller 36 be so mounted as to have contact under pressure with the circumferential surface of the heated roller 2 and to be rotated by the heated roller 2, and that said contact position be ranging from the position P2 where the applicator 28 has a pressing contact with the heated roller 2 to the nip position of the press roller 9 and the heated roller 2 along the direction of rotation of the heated roller 2. By provision of this levelling roller 36, the offset preventing liquid 23 fed to the surface of the heated roller 2 in the above-mentioned manner is allowed to form temporarily a reservoir zone between the roller 36 and the heated roller 2 and the liquid 23 is fed to the pressing contact position, namely the nip position between the press roller 9 and the heated roller 2, in the state where the liquid 23 is uniformly coated in a film-like form on the surface of the heated roller 2. By virtue of this arrangement, offset of toner onto the surface of the heated roller can be effectively prevented by the use of a minimum amount of the offset preventing liquid, and contamination or staining of a copying paper with the offset preventing liquid can be effectively prevented and fusing of a toner image can be performed conveniently.

In the foregoing embodiment illustrated in the drawings, the contact heat fixing device is integrated with a pair of said discharge rollers 21 and 22 by means of the frame plate 1, and the assembly is dismountably disposed in a prescribed position of an electrophotographic copying machine or electrostatic printing machine. The heated roller 2 and the discharge roller 21 are driven and rotated in the following manner.

Gears 37 and 38 are fixed to one ends of the heated roller 2 and discharge roller 21, respectively, and they are connected through gears 41 and 42 rotatably mounted on shafts 39 and 40 fixed to the frame plate 1, respectively. When the contact heat fixing device is disposed in a prescribed position in the above-mentioned copying or printing machine, the gear 37 is pivotally mounted on a shaft 43 fixed to a machine frame (not shown) and is promptly engaged with a gear 45 fixed to a sprocket 44. This sprocket 44 is rotated by a chain 46 transmitting a driving force from a driving mechanism in the machine, and this driving force is transmitted to the gear 37 through the gear 45 and to the gear 38 through the gears 41 and 42, whereby the heated roller 2 and discharge roller 21 are rotated.

As is apparent from the foregoing illustration, according to the present invention, by adoption of a very simple structure, it is made possible to feed an offset preventing liquid to the heated roller in a minimum amount necessary for preventing offset at every copying operation and to feed, in a preferred embodiment, the offset preventing liquid to the nip point between the heated roller and the press roller in the form of thin film by means of the levelling roller, whereby prevention of offset onto the surface of the heated roller and fusing of a toner image can accomplished effectively without contamination of staining of a copying paper with the offset preventing liquid. Moreover, degradation, abrasion or deformation of the offset preventing liquid applicator by the heat of the heated roller can be effectively prevented, and therefore, the durability of the applicator can be highly enhanced. Thus, it is apparent that the present invention makes great contributions to the art.

What we claim is:

1. A contact heat fixing device which comprises a driving heated roller having a heating mechanism disposed in the interior thereof and a surface coated with an offset preventing material, a press roller which is rotatable in intimate contact under pressure with said heated roller, said press roller and heated roller being rotatably mounted on a frame plate, a vessel for containing therein an offset preventing liquid and a feed mechanism for supplying the offset preventing liquid to the heated roller from the vessel, fixation of a toner image being accomplished by the passage of a support having the toner image thereon through the nip position of the heated roller and the press roller, wherein said feed mechanism includes an applicator for applying the offset preventing liquid to the surface of the heated roller and supply means for supplying the offset preventing liquid from the vessel to the applicator, said applicator being a roller, at least the surface portion of which is composed of a porous, heat-resistant and abrasion resistant material having a liquid absorbing property, said applicator roller being supported by a swingable arm so that it can be rotated only in the same direction as that of rotation of the heated roller and it can shift between a position (P1) where it has a pressing contact with said supply means and a position (P2) where it has a pressing contact with said heated roller, said swingable arm being fixed to a shaft which is rotatably mounted on the frame plate and connected through a linkage to an electromagnetic solenoid mechanism said solenoid mechanism being energized in connection with a mechanism to be actuated at every copying operation synchronously with feeding of the support, so that when said solenoid mechanism is energized, the applicator roller is moved to said position P2 to have a temporary contact with the surface of the heated roller and apply thereto the offset preventing liquid and when said solenoid mechanism is de-energized, said applicator roller being returned to the original position P1 by its own weight, and said applicator roller and said supply means being arranged in such a positional relationship that while the applicator roller shifts from the position P1 to the position P2, the applicator roller is rotated by frication with said supply means.

2. A contact heat fixing device as set forth in claim 1 wherein said supply means is composed of a porous material having a liquid absorbing property, and one end of said porous material is located above the liquid level in the vessel at the position P1 where it has a pressing contact with the applicator and the other end of said porous material is immersed in the offset preventing liquid in the vessel.

3. A contact heat fixing device as set forth in claim 1 wherein said supply means is composed of a porous material having a liquid absorbing property and is located above the liquid level in the vessel, said supply means includes a portion extending substantially in the horizontal direction and a portion immersed in the offset preventing liquid filled in the vessel, said applicator roller and supply means are arranged in such a positional relationship that said horizontal extending portion of the supply means is frictionally engaged with the applicator roller at least at said position P1, a stopper is disposed on the horizontal extending portion of the supply means to stop the applicator roller at said position P1, and the degree of the friction between the applicator roller and the horizontal extending portion of the supply means is such that every time the applicator roller makes one course of the swinging movement, the applicator roller contacts the horizontal portion of the supply means at a portion of the surface that is different from the portion where it had contact with the supply means before the swinging movement.

4. A contact heat fixing device as set forth in claim 1 wherein a levelling roller is so mounted as to have contact under pressure with the circumferential surface of the heated roller so as to be rotatable by the heated roller, said contact position ranging from said position (P2) and said nip position to the nip point between the heated roller and the press roller along the direction of rotation of the heated roller, whereby the layer of the offset preventing liquid applied to the surface of the heated roller is uniformly levelled in the form of a thin film.

* * * * *